US006379156B1

(12) United States Patent
Laravea et al.

(10) Patent No.: US 6,379,156 B1
(45) Date of Patent: Apr. 30, 2002

(54) APPARATUS AND METHOD FOR ORGANIZING AND STRATEGIZING TEAM PLAY

(76) Inventors: L. Scott Laravea, 9455 Dominion Way, Alpharetta, GA (US) 30022; Forrest F. Swyden, 320 Saddle Hill Ct., Roswell, GA (US) 30075

( * ) Notice: Subject to any disclaimer, the term of this patent is extended or adjusted under 35 U.S.C. 154(b) by 0 days.

(21) Appl. No.: 09/522,890

(22) Filed: Mar. 10, 2000

Related U.S. Application Data

(60) Provisional application No. 60/123,551, filed on Mar. 10, 1999, now abandoned.

(51) Int. Cl.[7] ..... A63B 69/00

(52) U.S. Cl. ..... 434/247; 434/248; 434/251; 434/416

(58) Field of Search ..... 434/247, 248, 434/251, 404, 405, 403, 408, 407; 281/21.1, 27.1, 31

(56) References Cited

U.S. PATENT DOCUMENTS 3,685,170 A * 8/1972 Fairleigh ..... 424/248
3,760,520 A * 9/1973 Hamilton ..... 40/102
4,676,527 A * 6/1987 Palmer ..... 281/31
5,704,646 A * 1/1998 Tzeng ..... 281/29
5,827,072 A * 10/1998 Neufer et al. ..... 434/416

* cited by examiner

*Primary Examiner*—Kien T. Nguyen
(74) *Attorney, Agent, or Firm*—Thomas, Kayden, Horstemeyer & Risley

(57) ABSTRACT

The organizer (10) includes a traditional ringed binder (12) which contains a strategy page (20), a storage page (40), a player position page (50), and magnetic player pieces (60). The strategy page includes a strategy board bearing a plan view of a playing field of a team sport which can be written on with a marker and disposed on the first surface of the page, and a roster board (25) on its opposite surface which includes a matrix having players' names, positions for the players and time played, and an open space below the matrix for notes by the coach. The storage page (40) and the position page (50) are both made of a ferrous metal, and magnetic player pieces (60) are releasably affixed to the storage page (40) and the position page (50) to provide instructions to the players.

12 Claims, 5 Drawing Sheets

APPARATUS AND METHOD FOR ORGANIZING AND STRATEGIZING TEAM PLAY

CROSS REFERENCE

This application claims the benefit of U.S. Provisional Application No. 60/123,551, filed Mar. 10, 1999 now abandoned.

TECHNICAL FIELD

The present invention generally relates to an apparatus and method to aid coaching of a team sport. More specifically, the present invention relates to a hand carried coach's play book used by a team coach for organizing and strategizing team play.

BACKGROUND OF THE INVENTION

The task of coaching team play, particularly youth soccer, can be filled with confusion. The attendance of the players to any one game can be difficult to predict and when the players are not playing on the field they tend to wander off to talk to parents or friends that are spectators of the game. This can make it difficult to strategize plays in advance or to keep track of who is in a game, who is out of a game, or who has already played in a game and who needs to play.

While there currently exist tools to aid individuals in coaching soccer, they are typically provided on individual papers or papers bound in a notebook or binder. These, however, are generally prepared in advance and therefore difficult to alter. Even if plays or position plans are developed upon arriving at the field on game day, any change in players available during the game can be difficult to adjust for without having to produce a whole new plan or cut and paste portions of the original plan with portions of a new plan.

It is also common for coaches of such teams playing recreational games not to use any organizational or strategy tools at all. As such, the coach may be unable to keep track of which players have played in which positions on the field and information may be lost in an attempt to communicate play strategies to the team. Furthermore, the coach would likely be required to spend more time explaining to each player what position they should be playing in, where that position is located on the field and strategy about how to play that particular position.

Another issue faced by many coaches of youth soccer is how to educate the young players about the game, the positions, and strategies for playing the game. Generally, to keep the interest of the younger players, such information should be provided in a simple, easy to comprehend manner.

SUMMARY OF THE INVENTION

The present invention is an apparatus and method to assist a coach in organizing and strategizing team play for a sport. The preferred apparatus comprises a coach's play book and organizer which includes a plurality of preferred contents which can be carried by a coach for ready access to the coach and the players. The organizer preferably includes a traditional ringed binder. The preferred contents for the organizer comprise a strategy page, a storage page, a position page, and a position indicator. Each of the preferred pages include a first surface and a second surface disposed parallel and opposite to each other, similar to the configuration of a traditional sheet of paper.

The pages for the organizer are preferably fixed in the organizer, similar to sheets of paper fixed in a traditional binder, such that the first surface of each page faces a corresponding direction and the second surface of each page faces a corresponding opposite direction.

The preferred strategy page includes a strategy board disposed on the first surface of the page and a roster board on the second surface. The strategy board preferably includes a schematic plan view of a field on which the team sport is played and the roster board preferably includes an open space for notes positioned below a player matrix. The second surface of the storage page comprises a storage space. The first surface of the position page includes a schematic of a plan view of a playing field on which the team sport is played. The storage page and the position page are both preferably comprised of a material attracted by a magnetic force. The position indicator or player pieces are preferably magnetic and therefore easily fixable to and movable about the storage page and the position page and arranged and configured to receive a label that may contain a variety of information.

DETAILED DESCRIPTION OF THE INVENTION

Figure 1:
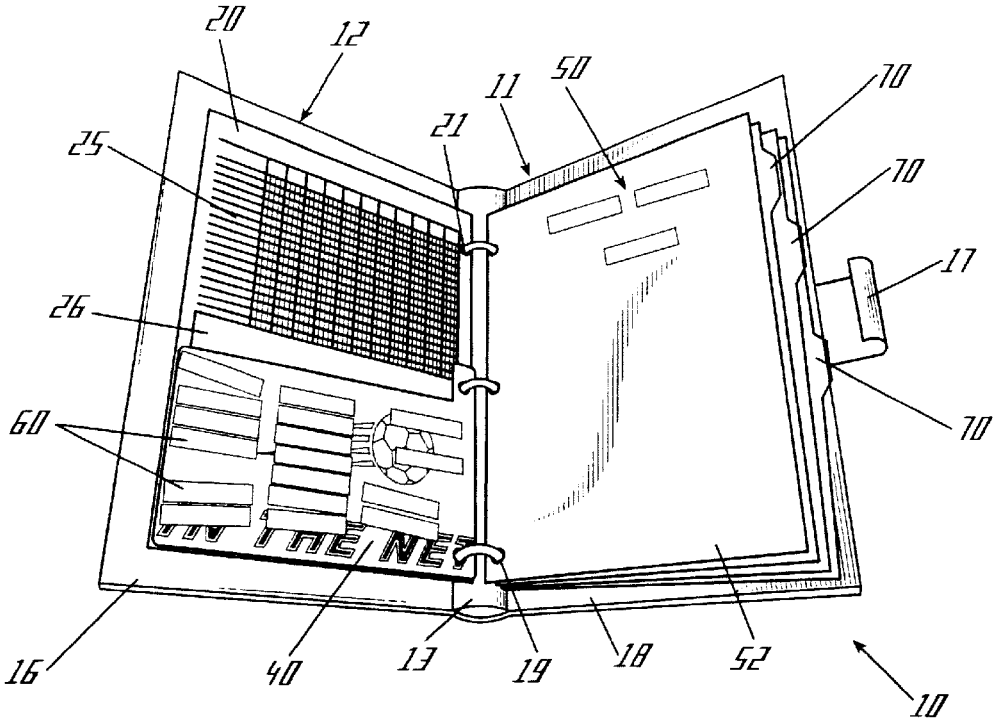
FIG. 1 is a perspective view of the assembled apparatus for organizing and strategizing team play.

FIG. 1 illustrates a preferred embodiment of an apparatus for organizing and strategizing team play 10, sometimes referred to as a coach's play book or notebook. While the apparatus 10 will be described herein specifically for coaching a team playing the game of soccer, it should be understood that the apparatus 10 can be used to assist in coaching various sports such as football, softball, baseball, hockey, volleyball, etc. The apparatus 10 preferably includes a traditional ringed binder 12 and preferred binder contents 11 fixed in the binder 12. The ringed binder 12 includes a front cover 16, a rear cover 18, and a centrally located binder 13 having a plurality of rings 19, or other fixing mechanism, for receiving and fixing substantially planar inserts or pages, such as thin rigid boards or sheets of paper. The front cover 16 and rear cover 18 of the ringed binder 12 are both preferably substantially rigid to facilitate easier use of the binder contents 11.

The binder 12 can include a closure tab 17 fixed to an outer portion of the rear cover 18 for holding the binder 12 in a closed position. The closure tab 17 may include any adequate means of maintaining the binder 12 in a closed position, however, it is preferable that the closure 17 tab include a portion of a hook and loop fastener while an outside portion of the front cover 16 includes the other or mating portion of a hook and loop fastener. When the binder 12 is in the closed position, a free end of the closure tab 17 can be extended to an outside portion of the front cover 16 such that the two portions of the hook and loop fastener (or other desirable closure system) are in contact with each other, thereby fixing the binder 12 in a closed position. The front cover 16 and rear cover 18 of the ringed binder 12 can further include storage space, such as pockets, pen holders, or the like, for holding various items the user desires to keep with them.

In the alternative, a conventional slide fastener can surround the three open sides of the notebook so as to make sure the contents of the notebook are not lost.

Figure 2:
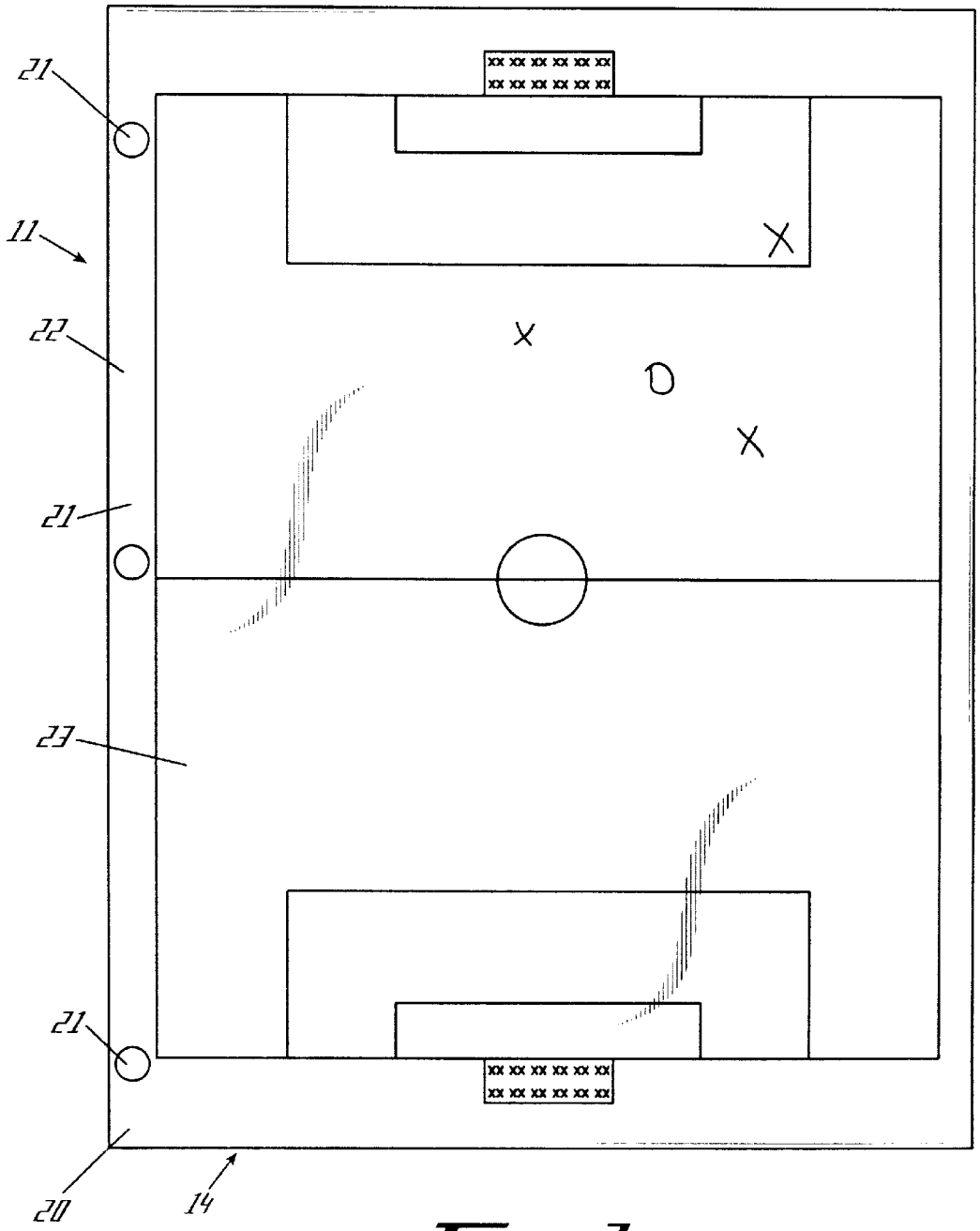
FIG. 2 is a planar view of the front surface of the strategy page of the apparatus illustrated in FIG. 1.

FIG. 2 illustrates the first page 14 of the book which has a first side or surface 22 which is the strategy page 20 that illustrates the playing field for the game of soccer. The first surface 22 preferably includes a schematic of a plan view of a soccer field 23 indicating the layout of the playing field. While the schematic of a soccer field is illustrated, it should be understood that the plan view provided on the first surface 22 can be of other playing fields for team play.

Figure 3:
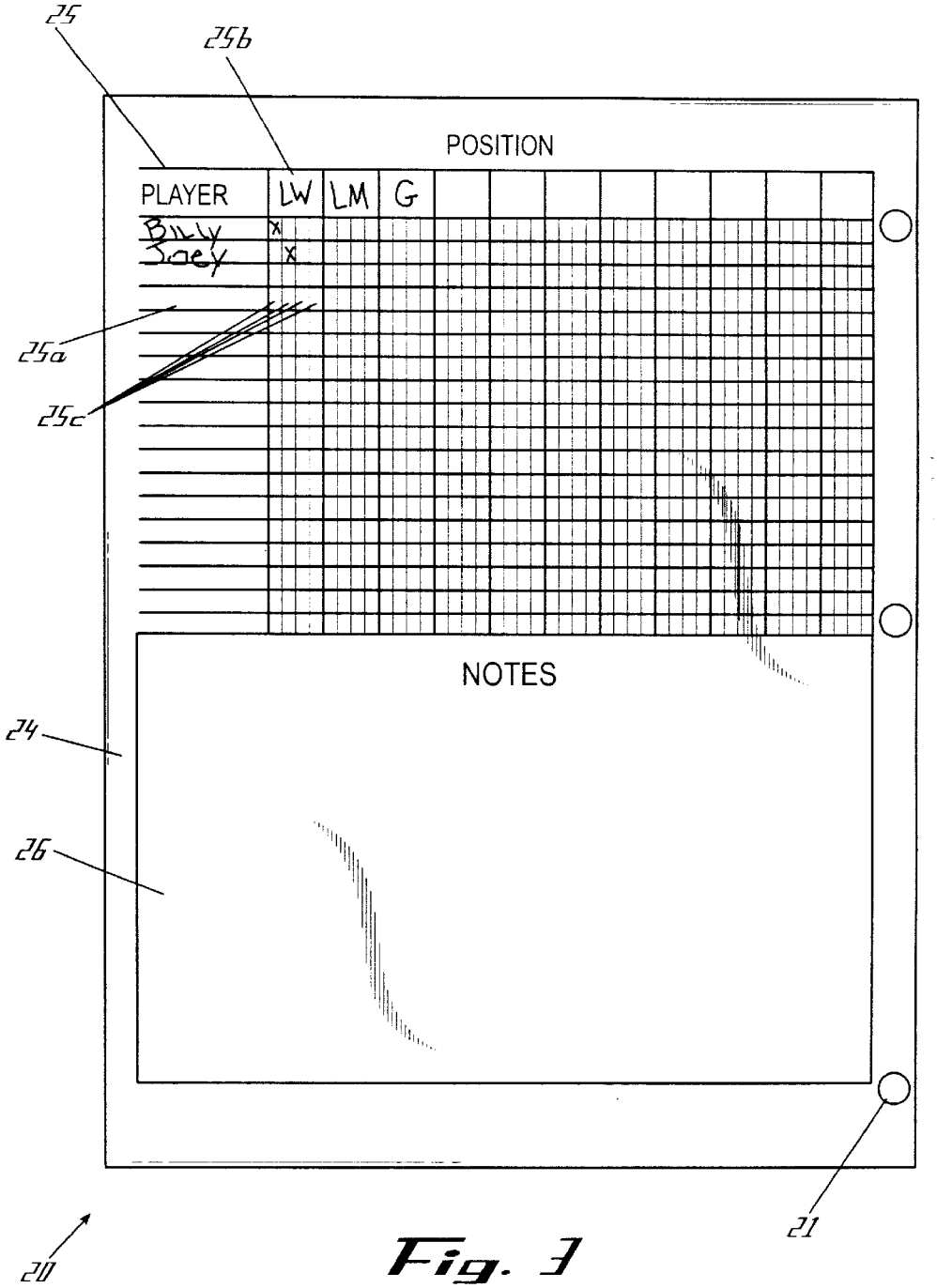
FIG. 3 is a planar view of the second surface of the strategy page of the apparatus illustrated in FIG. 1.

FIG. 3 illustrates the roster insert page 24 which, in this embodiment, is the back surface of first page 14, opposite the strategy page 20, and which illustrates the roster of players and the time and positions played. In structure, the roster page 24 is disposed parallel to and opposite the strategy page 20, such as on opposite sides of a single page. The roster page 24 preferably includes a players' roster, position and playing time matrix 25 and an open space for notes 26. The preferred player matrix 25 includes a vertical column of spaces 25*a* for hand-written entries across the page along a y-axis to record the names of players on the team being coached. The matrix further includes a horizontal line of spaces 25*b* across the top of the page for hand-written entries along an x-axis to insert various positions to be played on the playing field. Each coordinate for a player and position combination is preferably divided to allow for four entries 25*c,* one entry per quarter of play. It should be noted that each coordinate for a player and position combination may be divided into any number of entries which can be determined as a function of the measurement of play time in the sport being played. With this matrix layout, the coach can keep track of how much time each player has played and which positions each player has played during each time period of play in a particular game. For example, as illustrated with the sample entries shown in FIG. 3, it is recorded that "Billy" played in the "LW" position during the first quarter of play and "Joey" played in the "LW" position during the second quarter of play. Neither "Billy" nor "Joey," however, played in the "LM" or "G" positions.

In layout, it is preferable that the roster page 24 is arranged such that the player matrix 25 is positioned above the open space for notes 26 and that the player matrix 25 and the open space for notes 26 each occupy approximately half of the roster page 24. While the preferred matrix for coaching soccer is herein described, it should be understood that other matrix layouts may be used for coaching soccer or other sports. Regarding structure, it is also preferable that the strategy page 20 and the roster page 24 are substantially flexible and both are covered with a material that will allow marking thereupon and easy erasure of those markings, resulting in reusable surfaces. Both the strategy page 20 and the roster page 24 preferably include a plurality of apertures 21 arranged and configured to be engaged by the rings 19 of the binder 13 and disposed toward one edge of the page such that the pages 20 and 24 can be moved about the rings 19 such as pages are turned in a traditional ringed binder.

Figure 4:
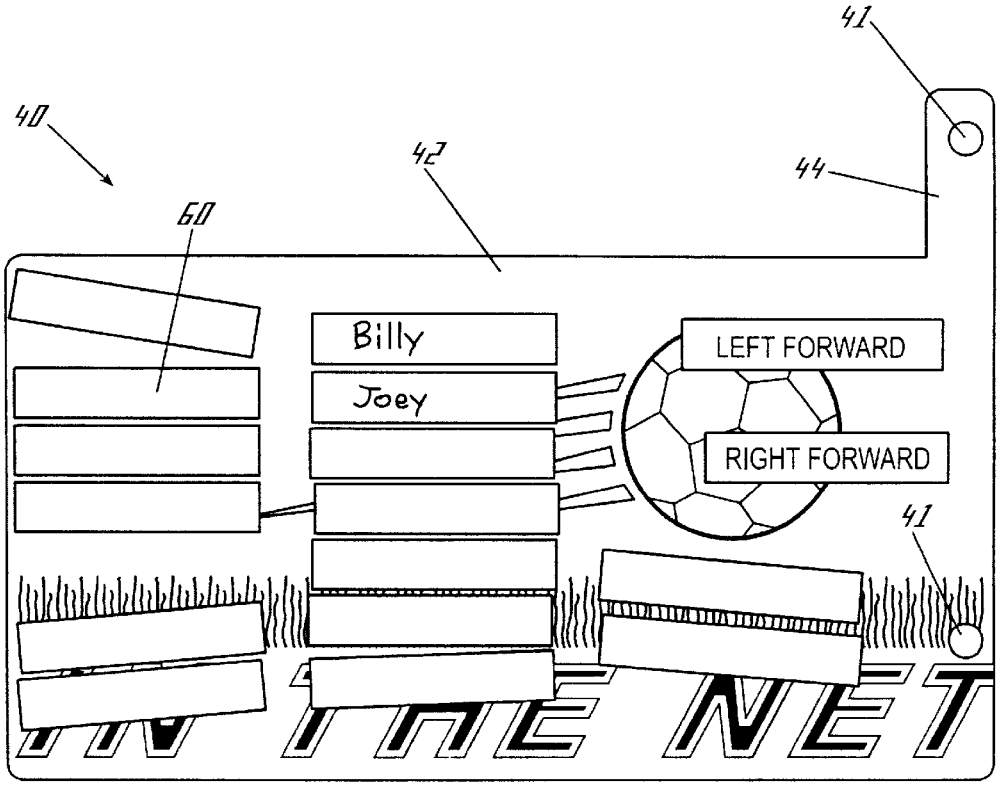
FIG. 4 is a planar view of the storage page of the apparatus illustrated in FIG. 1 with position indicators disposed thereon.

FIG. 4 illustrates a second page of the preferred binder contents 11 which is the player piece storage page 40. A second surface 42 of the storage page 40 is illustrated. The second surface 42 may either be blank or include decoration or a logo, as shown in FIG. 4. It is preferred that the storage page 40 be one-half the height of the other pages and includes apertures 41 arranged and configured to be engaged by the rings 19 such that the storage page 40 can be moved about the rings 19 such as pages are turned in a traditional ringed binder and expose the upper portions of the adjacent pages. In its preferred embodiment, the storage page 40 is configured to correspond in size with and cover the open space for notes 26 on the strategy page 20 (FIG. 3) while revealing the player matrix 25 at the top of the roster page 24. As such, the storage page 40 can include a tab 44 extending from an upper edge of the storage page 40 into which an aperture 41 can be formed such that the storage page 40 can be engaged by at least two of the plurality of binder rings 19. The storage page 40 is substantially rigid and comprises a powder coated ferrous material that is attracted by a magnetic force. It should be understood that the player piece storage page 40 may comprise any suitable material, however, it is preferable that the storage page 40 provide a surface 42 upon which the player pieces or position indicators 60 may be movably mounted thereon to facilitate easy removal of the indicator 60 or movement from one position to another about the surface 42.

Figure 5:
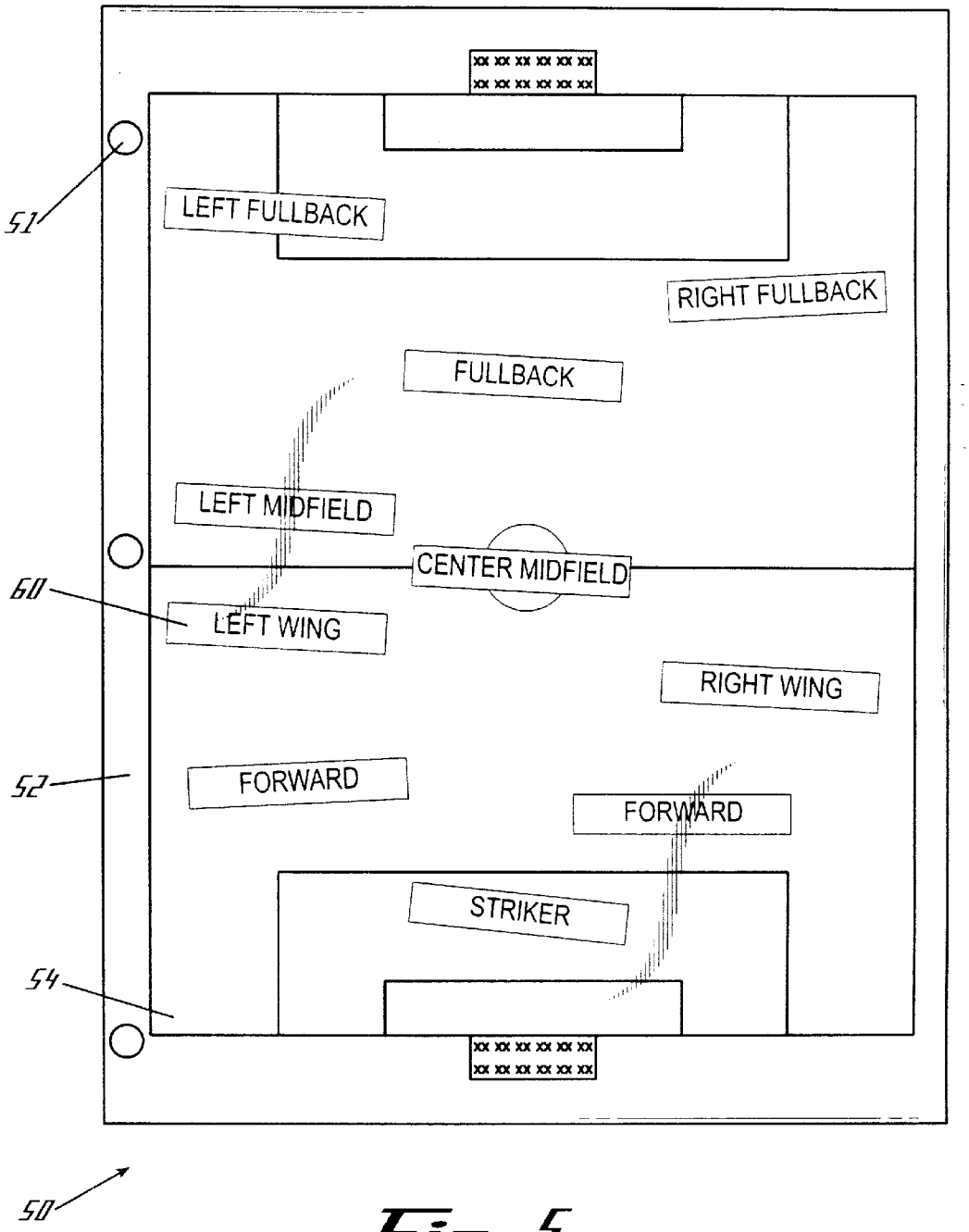
FIG. 5 is a planar view of the first surface of the position page of the apparatus illustrated in FIG. 1 with position indicators disposed thereon.

FIG. 5 illustrates a third page of the preferred binder contents 11, the player position page 50. A first surface 52 of the position page 50 preferably includes a plan view of soccer playing field 54. It should be understood that the first surface 52 of the position page 50 can include the plan view of other surfaces upon which a sport can be played. The position page 50 is substantially rigid and comprises a powder coated ferrous metal that is attracted by a magnetic force. It should be understood that the position page 50 may comprise any suitable material, however, it is preferable that the position page 50 provide a surface 52 upon which a position indicator 60 can be releasably affixed thereto to facilitate easy removal of the indicator 60 or movement of the position indicator from one position to another about the surface 52.

Figure 6:
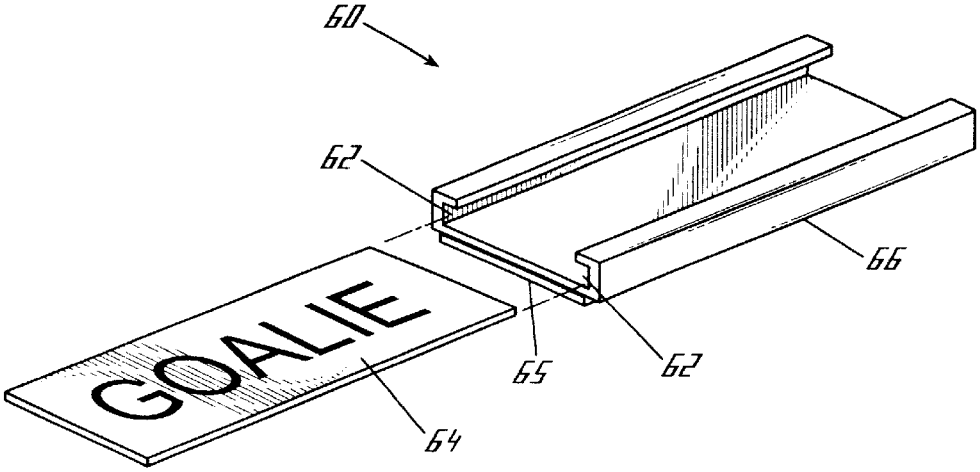
FIG. 6 is a perspective view of the position indicator of the apparatus illustrated in FIG. 1.

FIG. 6 illustrates a preferred embodiment of a player piece or position indicator 60 such as illustrated in FIGS. 4 and 5. The preferred position indicator 60 includes a substantially rigid and planar contact bottom surface 66 and opposed side channels 62 into which a label 64 can be inserted. The label 64 preferably includes the name of a position in the sport such as "goalie" or can include the name of a team player or other indicia. The label 64 can also be provided blank, without any writing, so that the coach may enter the desired information thereon. The position indicator 60 is formed of magnetic material or is mounted on a magnetic strip 65 for interacting with the ferrous material of the second surface 42 of the storage page 40 and of the first surface 52 of the position page 50. In use, the position indicator 60 can be positioned on the storage page 40 or on the position page 50 at the contact surface 66. It is preferred that the position indicator 60 is magnetic and thus can attract the second surface 42 of the storage page 40 and the first surface 52 of the position page 50. It is preferred that the strength of the magnetic force releasably affixes the position indicator 60 to the desired pages therefore rendering the indicator easily movable about the surface of each respective page and between each respective page.

FIG. 1 illustrates a preferred assembly configuration of the binder contents 11 within the ringed binder 12. It is preferable that the apertures 21 of the strategy page 20 (FIG. 2) are disposed to a side of the first surface 22 such that the first surface 22 faces the front cover 16 of the book 12 when the apertures 22 are engaged by the rings 19. It is further preferred that the strategy page 20 (FIG. 2) is fixed in the binder 12 such that the player matrix 25 (FIG. 3), located on the second surface 24 of the strategy page 20, is disposed above the open space for notes 26 and that both are facing the rear cover 18 of the binder 12.

The position page 50 (FIG. 5) is preferably fixed into the binder 12 by the rings 19 at the apertures 51 such that the first surface 52 of the position page 50 faces the front cover 16 when the apertures 51 are engaged by the rings 19. Finally, the storage page 40 (FIG. 4) is preferably fixed into the binder 12 at the apertures 41 such that the second surface 42 (FIG. 4) faces the rear cover 18 of the binder 12 and is disposed between the strategy page 20 (FIG. 3) and the position page 50 (FIG. 5). It is further preferable that the storage page 40 is fixed in the binder 12 such that it corresponds in position and dimension to the open space for notes 26 disposed on the second surface 24 of the strategy page 20.

A plurality of position indicators or player pieces 60 (FIG. 6) can be disposed on either the second surface 42 of the storage page 40 (FIG. 4) or on the first surface 52 of the positions page 50 (FIG. 5) or on both. The position indicators 60 can bear a player's name or the name of a position.

It is further preferable that the apparatus 10 include organizational tabbed dividers 70. The dividers may be used for organizing such information as, for example, the rules of the league, the season schedule, the team roster, etc., which can be hole punched at a side edge and attached in the play book with the rings 19.

In use, the apparatus 10 has two preferred open positions. In the first preferred open position, the first surface 22 of the strategy page 20 of FIG. 2 is accessible. In the first open position the coach, or other user of the apparatus 10, has access to the schematic of the playing field provided on the first surface 22 of the strategy page 20. In the preferred embodiment the user can place hand written marks on the schematic to indicate desired positions or movement about the field of play.

In a second open position, a portion of the second surface 24 of the strategy page 20 (preferably the portion including the player matrix 25 of FIG. 3), the second surface 42 of the storage page 40 of FIG. 4, and the first surface 52 of the position page 50 of FIG. 5 are accessible simultaneously. In the second preferred open position (shown in FIG. 1) a plurality of position indicators 60 can be preferably magnetically fixed to the first surface 52 of the position page 50 to indicate positions to be played or strategies of play, while the positions and/or players not indicated on the plan view of the playing field 54 can remain magnetically fixed to the second surface 42 of the storage page 40. The preferred configuration of the storage page 40 allows the player matrix 25, disposed on the upper portion of the second surface 24 of the strategy page 20, to be accessible while the notebook is in this open position.

Finally, tabbed dividers 70 may be included to organize additional information. This configuration allows a user to strategize plays, keep abreast of which players are on the field and which are off the field, and keep track of which players have played each position. The apparatus 10 provides an organized, easily alterable tool for coaching soccer, particularly for youths.

The first surface 52 of the position page 50 can be used as an educational tool in coaching youth soccer. More specifically, a position indicator 60 having the name of each position of play labeled thereon can be placed on the schematic of the soccer field in the appropriate corresponding position on the schematic. An additional indicator 60 having the name of a player labeled thereon can then be placed adjacent the indicator 60 labeled with a position. The apparatus 10 can then be shown to the players to indicate to them their position of play and also teach them the various positions, where they are located on the playing field and what they are called. This also provides an organizational benefit as the apparatus 10 can be set down on a bench or somewhere on the sidelines for the players to look at before play begins to know where they are to be positioned on the field without requiring the coach to find each player individually and explain where their position is located.

Although a preferred embodiment of the invention has been disclosed in detail herein, it will be obvious to those skilled in the art that variations and modifications of the disclosed embodiment can be made without departing from the spirit and scope of the invention as set forth in the following claims.

What is claimed is:

1. A notebook for coaching a sports game including a front cover page (16) and a rear cover page (18) and a binder (13), said front and rear cover pages hingedly connected to said binder, said binder including page connector rings adjustable between an open position and a closed position, said notebook further comprising:

a first page (14) having opposed first and second surfaces, said first surface of said first page comprising a strategy page (20) illustrating a field of play, and said second surface comprising a roster page (24) having at its upper portion a players' roster matrix illustration (25) for applying players' names and illustrating periods **(25*c*)** in which players have played the game:

a player piece storage page (40) positioned adjacent said roster page and being of dimensions less than said first page for exposing said roster matrix illustration when in overlying relationship with said roster page, said storage page being made of a ferrous metal which is attracted to magnetism;

a player position page (50) facing said player piece storage page (40) and said roster page (24), being made of a ferrous material which is attracted to magnetism, and illustrating a field of play;

a plurality of player pieces (60) for placement on said storage page (40) and on said player position page (50) for indicating the identification of a player and the player's position on the playing field, made of a magnetic material for clinging to said player position page and said player piece storage page.

2. A notebook for coaching a team sport including a front cover hingedly connected to a rear cover and a ring binder therebetween, comprising:

a strategy page (20) having a strategy board on a first surface and a roster board on a second surface, said second surface of said strategy page being disposed parallel and opposite said first surface, said first surface of said strategy page including a planar view of a field on which the team sport is played and said second side of said strategy page including an open space for notes and an organizational player roster matrix disposed thereabove;

said strategy page being removably fixed adjacent the inner portion of the notebook at a plurality of fixing apertures disposed adjacent an edge of said strategy page and engaged by the plurality of rings such that said first surface of said strategy page is adjacent the front cover of the notebook;

a players position piece storage page (40) having dimensions substantially less than the notebook dimensions and a first surface and a second surface being parallel and opposite each other, said second surface comprises a storage space;

wherein said storage page is removably fixed at a plurality of fixing apertures disposed adjacent an edge of said storage page and engaged by a portion of the plurality of rings such that said second surface of said storage page faces a direction corresponding to said second surface of said strategy page;

a position page (50) having a first surface and a second surface disposed parallel and opposite said first surface, said first surface of said position page including a planar view of a playing field on which the team sport is played, said position page being removably fixed at a plurality of fixing apertures disposed adjacent an edge of said position page and engaged by the plurality of rings such that said first surface faces an opposing direction of said second surface of said storage page; and a plurality of player position pieces (60) each configured such that a plurality of position pieces can be disposed on said storage page and said positions page, said indicators arranged and configured to be releasably engaged by said storage page and said position page, said indicator being movable between said storage page and said positions page and upon said storage page and said positions page.

3. A notebook for coaching a team sport including a front cover hingedly connected to a rear cover and connector rings being adjustable between an open position and a closed position, the rings disposed adjacent the hinged connection and on the inner portion of the notebook, said notebook comprising:

a first page (14) having a strategy board (20) on a first surface and a roster board (24) on a second surface, said second surface of said page is obverse said first surface, said first surface of said strategy page including a planar view of a field on which the team sport is played, said roster board having player positions spaces and periods played by each player;

a storage page (40), said storage page having a first surface and a second surface, said second surface of said storage page facing a direction corresponding to said second surface of said strategy page, said storage page being arranged and configured such that a portion of said roster board extends beyond said storage page;

a positions page having a first surface and a second surface, said first surface facing an opposing direction of said second surface of said storage page, said first surface of said position page including a planar view of a playing field on which the sport is played; and player position pieces each configured such that a plurality of indicators can be disposed on said storage page and said positions page, said indicator arranged and configured to be releasably engaged by said storage page and said positions page, said indicator being movable between said storage page and said positions page and upon said storage page and said positions page;

wherein said strategy page, said storage page and said position page are releasably fixed in the notebook by the rings in the notebook such that said pages pivot about the rings of the notebook.

4. An apparatus for organizing and strategizing team play, the apparatus comprising:

an organizer, said organizer having a substantially planar surface and a fixing mechanism;

a strategy page, said strategy page having a strategy board on a first surface and a roster board on a second surface, said second surface of said page being disposed parallel to and opposite said first surface, said first surface of said strategy page including a plan view of a field on which the team sport is played and said second side of said strategy board including an open space for notes and an organizational player matrix disposed thereabove;

wherein said strategy page is removably fixed to said organizer by said fixing mechanism;

a storage page, said storage page having a first surface and a second surface being parallel and opposite each other, said second surface comprises a storage space;

wherein said storage page is removably fixed to said organizer by said fixing mechanism;

a position page, said position page having a first surface and a second surface disposed parallel and opposite each other, said first surface of said position page including a plan view of a playing field on which the team sport is played;

wherein said position page is removably fixed to said organizer by said fixing mechanism; and a position indicator, said position indicator configured such that a plurality of indicators can be disposed on said storage page and said position page, said position indicator arranged and configured to be releasably fixed to said storage page and said position page, said position indicator being movable between said storage page and said position page and movable about said storage page and said position page;

wherein said strategy page, said storage page, and said position page are fixed in said organizer such that a portion of said strategy page, said storage page and said position page can be accessed simultaneously to facilitate organization and strategy planning for the team play.

5. The apparatus of claim 4, wherein said substantially planar surface of said organizer is substantially rigid.

6. The apparatus of claim 4, wherein said organizer further comprises:

a second substantially planar surface being hingedly fixed to said substantially planar surface.

7. The apparatus of claim 4, wherein said second substantially planar surface is substantially rigid.

8. The apparatus of claim 4, wherein said strategy page comprises a substantially flexible sheet having a coating disposed thereon, said coating providing a surface whereby markings can be easily placed thereon and removed therefrom.

9. The apparatus of claim 4, wherein said storage page comprises a substantially rigid, powder coated ferrous material.

10. The apparatus of claim 4, wherein said position page comprises a substantially rigid, powder coated ferrous material.

11. The apparatus of claim 10, wherein said position indicator comprises a substantially rigid magnetic material which releasably affixes itself to said strategy page.

12. An apparatus for organizing and strategizing team play for the sport of soccer, the apparatus comprising:

an organizer, said organizer having predetermined dimensions, an inner portion and an outer portion, a front cover hingedly connected to a rear cover and a plurality of rings being adjustable between an open position and a closed position and disposed adjacent the hinged connection and on the inner portion of the organizer;

a strategy page, said strategy page having dimensions corresponding to said organizer, said strategy page including a strategy board on a first surface and a roster board on a second surface, said second surface of said page being disposed parallel and opposite said first surface, said first surface of said strategy page including a plan view of a soccer field and said second surface of said strategy board including an open space for notes and an organizational player matrix disposed thereabove;

wherein said strategy page is removably fixed adjacent said inner portion of said organizer at a plurality of fixing apertures disposed adjacent an edge of said strategy page and engaged by the plurality of rings such that said first surface of said strategy page is adjacent said front cover of said organizer;

a storage page, said storage page having dimensions substantially less than said organizer dimensions and a first surface and a second surface being parallel and opposite each other, said second surface comprises a storage space;

wherein said storage page is removably fixed at a plurality of fixing apertures disposed adjacent an edge of said storage page and engaged by a portion of the plurality of rings such that said second surface of said storage page faces a direction corresponding to said second surface of said strategy page;

a position page, said position page having a first surface and a second surface disposed parallel and opposite said first surface, said first surface of said position page including a planar view of a soccer field;

wherein said position page is removably fixed at a plurality of fixing apertures disposed adjacent an edge of said position page and engaged by the plurality of rings such that said first surface faces an opposing direction of said second surface of said storage page;

a position indicator, said position indicator configured such that a plurality of indicators can be disposed on said storage page and said position page, said indicator arranged and configured to be releasably engaged by said storage page and said position page, said indicator being movable between said storage page and said positions page and about said storage page and said position page;

wherein said strategy page, said storage page, and said position page are fixed in said organizer such that a portion of said strategy page, said storage page and said position page can be accessed simultaneously to facilitate organization and strategy planning for the team play; and a tabbed divider fixed in said organizer by the plurality of rings.

* * * * *